United States Patent [19]

O'Connell et al.

[11] Patent Number: 4,998,764

[45] Date of Patent: Mar. 12, 1991

[54] COMBINATION HANDLE AND JAR BRACKET FOR PUMPS

[75] Inventors: Mark E. O'Connell, Cedar Grove; Roy J. Rozek, Plymouth, both of Wis.

[73] Assignee: Thomas Industries Inc., Louisville, Ky.

[21] Appl. No.: 569,590

[22] Filed: Aug. 20, 1990

Related U.S. Application Data

[63] Continuation of Ser. No. 260,064, Oct. 20, 1988, abandoned.

[51] Int. Cl.[5] ..... B65D 85/00

[52] U.S. Cl. ..... 294/146; 294/137; 294/27.1; 16/124; 16/110.5

[58] Field of Search ..... 294/137, 143, 146, 159, 294/165, 27.1, 31.2, 15, 92; 55/357; 16/110 R, 124, 110.5, DIG. 25; 239/375, 532; 248/314, 315, 312.1; 417/234; 220/85 S, 85 P; 137/376, 382

[56] References Cited

U.S. PATENT DOCUMENTS

| | | | |
|---|---|---|---|
| 687,619 | 11/1901 | Louse | 294/137 X |
| 1,089,754 | 3/1914 | Feeny | 16/DIG. 25 X |
| 1,533,893 | 4/1925 | Perry | 294/27.1 X |
| 1,707,883 | 4/1929 | Silva | 294/137 X |
| 1,858,299 | 5/1932 | Korn | 294/159 X |
| 1,985,571 | 12/1934 | Hetzel | 294/137 X |
| 2,302,446 | 11/1942 | Kincaid | 294/146 |
| 2,348,187 | 5/1944 | Beskin | 294/87.28 |
| 2,617,143 | 11/1952 | Blake | 294/137 X |
| 2,650,128 | 8/1953 | Failor | 294/87.28 X |
| 2,818,299 | 12/1957 | Payne | 239/375 X |
| 3,128,022 | 4/1964 | Mastrud, Jr. | 294/146 |
| 3,144,269 | 8/1964 | Orr | 294/165 X |
| 3,167,211 | 1/1965 | McCormick | 294/159 X |
| 3,701,463 | 10/1972 | Goss | 294/142 |
| 3,738,525 | 6/1973 | Knapp | 294/146 X |
| 3,820,696 | 6/1974 | Gongolewski | 294/141 |
| 4,458,933 | 7/1984 | Thomas | 294/31.2 |
| 4,486,044 | 12/1984 | Gordon et al. | 294/146 X |
| 4,609,200 | 9/1986 | Winter | 294/137 X |
| 4,667,822 | 5/1987 | Coopmans | 294/146 X |
| 4,753,474 | 6/1988 | Radford | 294/31.2 X |

FOREIGN PATENT DOCUMENTS

| | | | |
|---|---|---|---|
| 116917 | 7/1946 | Sweden | 294/137 |

*Primary Examiner*—Margaret A. Focarino
*Assistant Examiner*—Joseph D. Pape
*Attorney, Agent, or Firm*—Hill, Van Santen, Steadman & Simpson

[57] ABSTRACT

A combination handle/bracket member is provided for use with a device, such as a suction pump, that is operated in conjunction with a separate component, such as a collection jar. The member is preferably a single-piece member with a 90° bend separating a manual grasping area from a component receiving area. Also preferably the member is secured to the device with fasteners that are already used to secure portions of the device together so that no additional fasteners are required.

12 Claims, 2 Drawing Sheets

COMBINATION HANDLE AND JAR BRACKET FOR PUMPS

This is a continuation, of application Ser. No. 07,260,064, filed Oct. 20, 1988, now abandoned.

BACKGROUND OF THE INVENTION

The present invention relates to carrying handles and in particular to a carrying handle for a pump.

Various types of handles are available for equipment and devices such as pumps and sometimes these handles include a stationary bracket which is secured to the equipment body in some manner to provide a grasping area to assist in lifting and moving of the equipment.

Oftentimes the equipment, such as a pump, utilize associated components which must be moved with the equipment. Either these components must be carried separately, or they are secured to the equipment by various fastening means which may include various types of brackets. This may lead to a complex assembly of brackets and fasteners and other parts required to accomodate the additional components while still permitting the equipment to be moved around by use of a handle.

SUMMARY OF THE INVENTION

The present invention provides a combination handle and component receiving bracket which comprises a one piece member secured to a device such as a pump in a manner which keeps the number and complexity of fasteners to an absolute minimum.

The combination handle/bracket comprises a single piece of metal which has a single right angle bend formed therein such that one end of the combination handle/bracket is in a vertical orientation and the remainder of the bracket is in a horizontal orientation. A cut out is provided in the piece, which cut out is intersected by the bend such that the upstanding end comprises two spaced upstanding legs with a connecting section therebetween at a terminal end of the combination handle/bracket. An opposite end of the combination handle/bracket has a second cut out formed therein which is sized to receive the component to be held in close proximity to the device.

For example, a jar having a generally circular circumference may be held in close proximity to a pump by having a circular cut out at the second end of the combination handle/bracket so that the jar may be received within the circular cut out. A circumferential lip on the jar or a sloping sidewall of the jar would hold the jar in place.

In a preferred embodiment, the combination handle/-bracket is easily and simply attached to the pump body by a pair of threaded fasteners which extend through the combination handle/bracket closely adjacent to the bend formed in the handle/bracket, the threaded fasteners normally being used to secure portions of the pump together. Thus, a complex assortment of brackets and fasteners is avoided while still providing the benefit of a handle and a bracket for carrying the associated component. Only a single bracket is required, and no new or additional fasteners; the fasteners previously required by the pump assembly being utilized to additionally secure the bracket to the pump.

DESCRIPTION OF THE PREFERRED EMBODIMENTS

Figure 1:
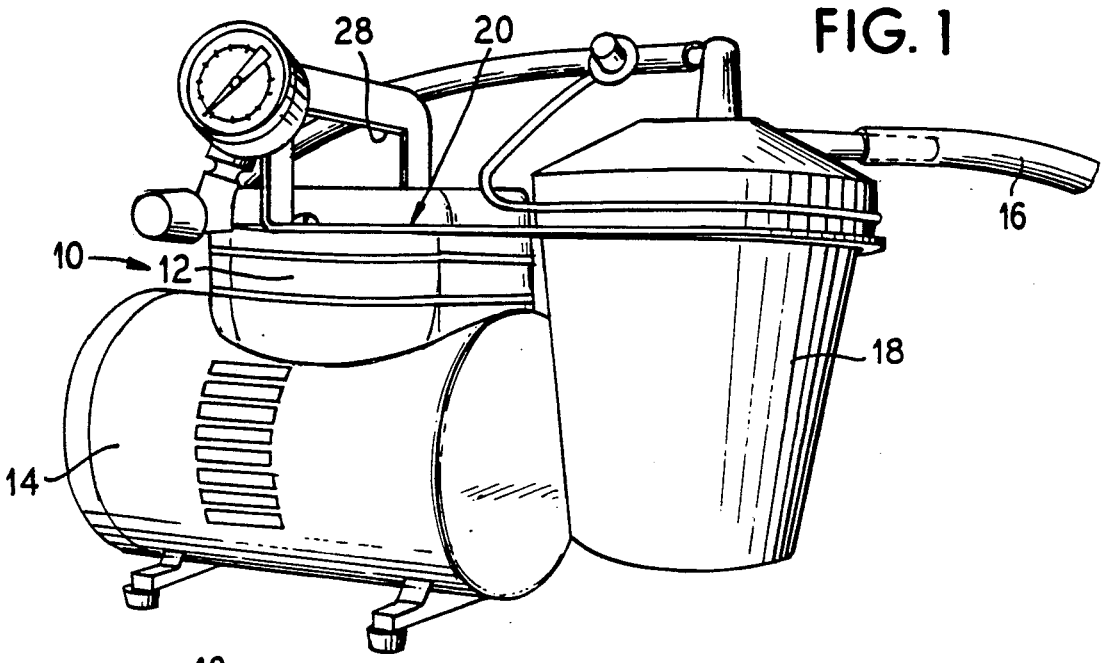
FIG. 1 is a perspective view of a pump and jar incorporating a combination handle and jar bracket embodying the principles of the present invention.
Figure 2:
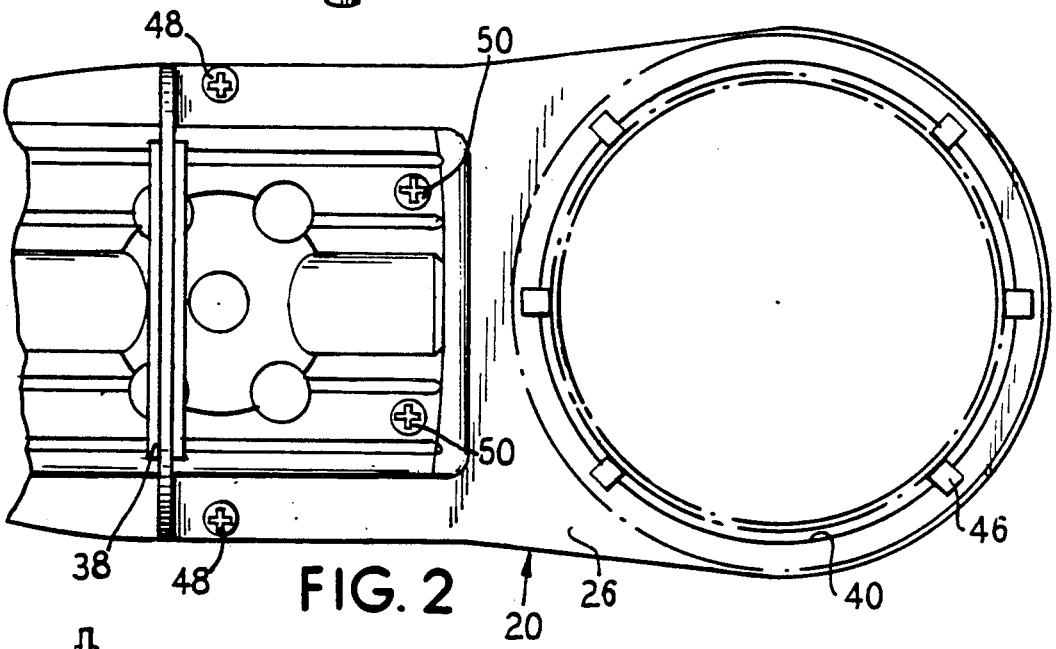
FIG. 2 is a plan view of the pump and combination handle/bracket of FIG. 1.
Figure 3:
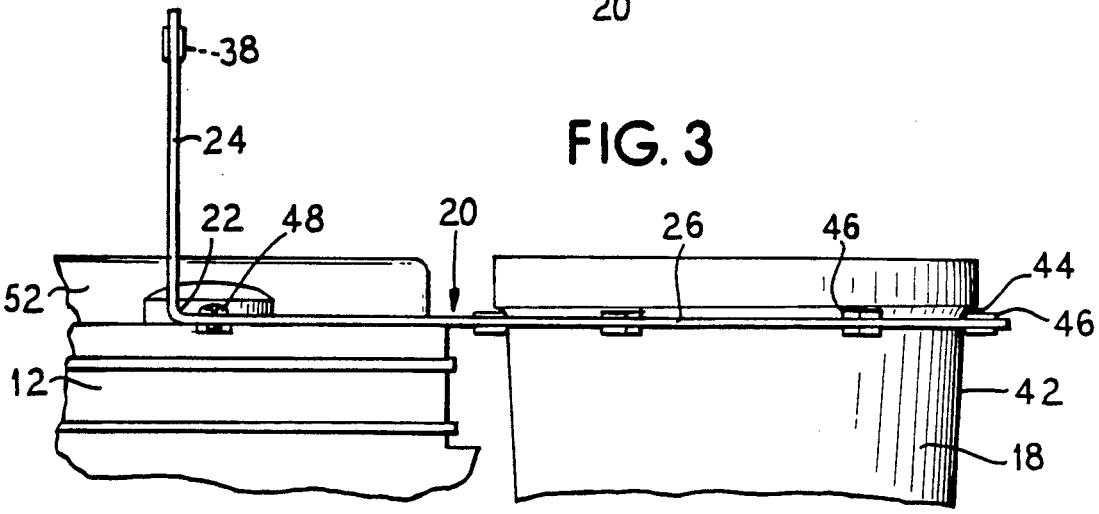
FIG. 3 is a side elevational view of the assembly of FIG. 1.
Figure 4:
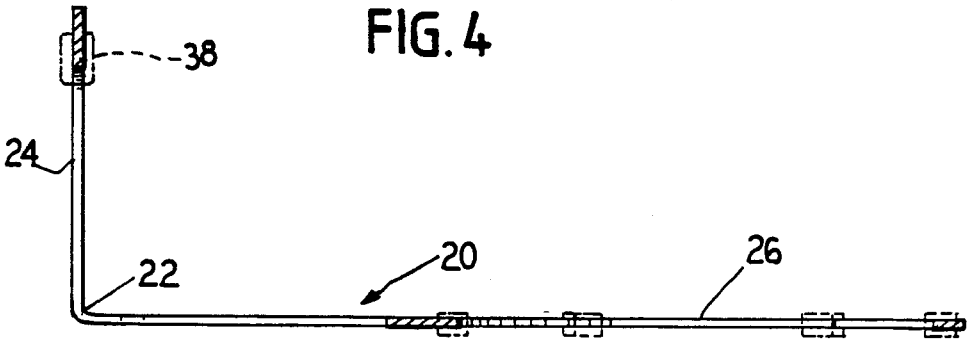
FIG. 4 is a side sectional view of the handle/bracket alone.
Figure 5:
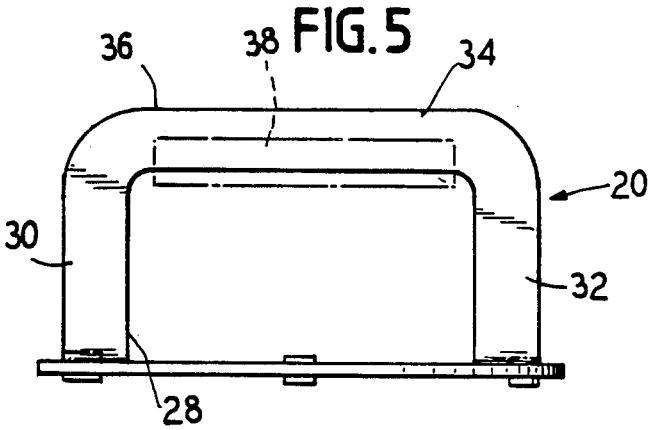
FIG. 5 is an end view of the handle/bracket alone.
Figure 7:
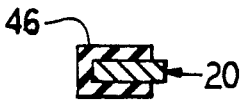
FIG. 7 is a sectional view through the handle/bracket taken generally along the line VII—VII of FIG. 6.
Figure 6:
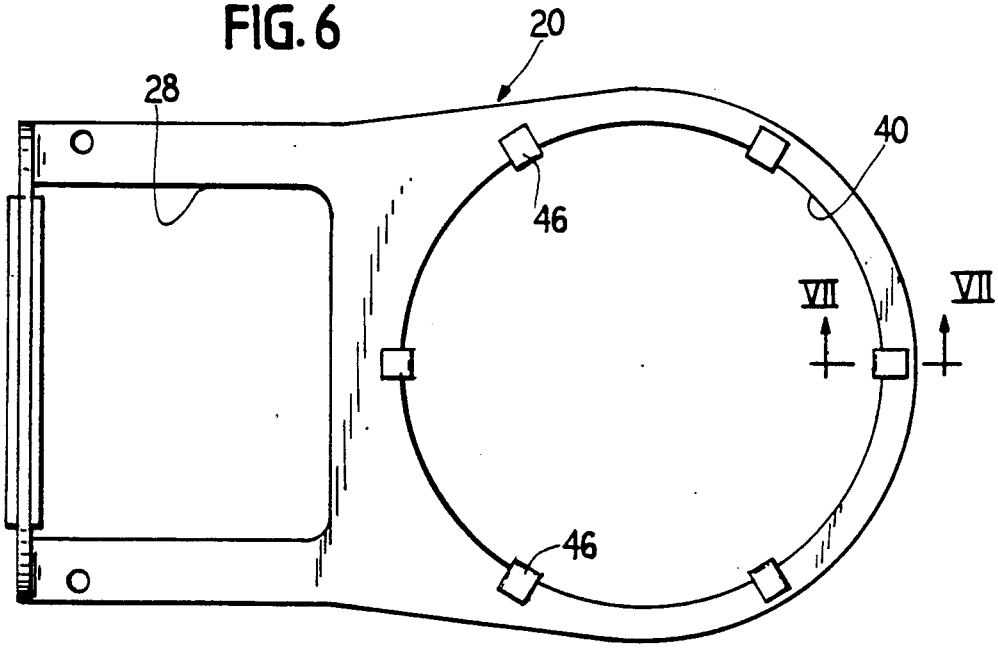
FIG. 6 is a plan view of the handle/bracket alone.

In FIG. 1 there is shown a device generally at 10 which, in the illustrated embodiment, comprises a diaphragm compressor vacuum pump 12 driven by a motor 14. Such a device has particular utility in some applications of producing a low pressure within a suction hose 16 which feeds into a collection jar 18. Such equipment is most useful when it is portable and therefore it is desireable to be able to easily pick up and move not only the pump and motor but also the collection jar as well. Therefore, a combination handle/bracket 20 is provided which is shown in greater detail in FIGS. 2-6. The handle/bracket is a single piece member, preferably formed of metal, but which could be formed from any rigid material, such as stiff plastic. The handle/-bracket members has a single right angle bend 22 (FIGS. 3 and 4) formed therein so that a first part or end 24 of the member is oriented vertically and a second part or end 26 is oriented horizontally. A first cut out 28 is intersected by the right angle bend 22 such that the cut out 28 is provided in both the first part 24 and second part 26.

The first part 24 therefore comprises two spaced apart vertical legs 30, 32 (FIG. 5) with a connecting horizontal portion 34 forming a terminal end 36 of the member 20. This first part 24 thus comprises the handle portion of the combination and the cut out thus provides an aperture for insertion of a user's hand to grasp around the horizontal connecting portion 34. If desired, a thickened member 38 may be applied to the horizontal connecting member 34 to provide a cushioned or wider grip area since the member is formed from a relatively thin plate-like member.

The horizontal portion 26 has a circular cut out 40 formed therein which is sized to receive the jar 18. The jar itself has an upwardly and outwardly sloping wall 42 as well as an upper lip 44 which permits the jar to be captured and held by the cut out 40. A plurality of cushioned pads 46 are provided around the circumference of the cut out 40 in a preferred embodiment to provide a resilient engagement mount for the jar.

The combination handle/bracket member is secured to the pump 12 by means of a pair of threaded fasteners 48 which are normally used in conjunction with additional threaded fasteners 50 to hold a top plate 52 of the pump housing onto the remainder of the pump housing. Thus, no additional fasteners are required to secure the combination handle/bracket 20 onto the equipment.

Thus it is seen that the present invention provides a combination handle/bracket member for use with a device such as a pump in which one end of the member acts as a handle and the other end of the member acts as a carrying device for a component, the entire member being a single piece and being secured to the device without the need for additional fasteners.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. A combination handle/bracket for use with a portable device and an associated component comprising:

a single piece handle/bracket formed from a plate-like member having a first end and a second end;

said first end having a first central cut-out therein forming a pair of opposed legs and a connecting portion at a terminal end of said first providing a manually graspable handle;

said second end having a second central cut-out therein forming a receptacle for said component;

a bend formed between said first end and said second end such that said first end is oriented at an angle relative to said second end; and fastening means, disposed between said handle and said second central cut-out, for securing said member to said device.

2. A combination handle/bracket according to claim 1, wherein said first end is perpendicular to said second end.

3. A combination handle/bracket according to claim 2, wherein said member comprises two planar end portions and a single right angle bend joining said two end portions.

4. A combination handle/bracket according to claim 1, wherein said fastening means comprises means used to secure portions of said device together.

5. A combination handle/bracket for use with a portable device and an associated component comprising:

a single piece member having a first end and a second end;

said first end having a first central cut-out therein forming a piar of opposed legs and a connecting portion at a terminal end of said first end providing a manually graspable handle and a 90 degree bend formed between said first end and said second end such that said first end is oriented perpendicular to said second end, said first cut-out extending through said 90 degree bend; and said second end having a second central cut-out therein forming a component receptacle.

6. A combination handle/bracket according to claim 5, wherein said manually graspable handle has a cross-sectional thickness greater than a cross-sectional thickness of any other region of said member.

7. A combination handle/bracket according to claim 6, wherein an additional element is secured to said handle to make it thicker than the remainder of said member.

8. A combination handle/bracket according to claim 5, wherein said second cut out is shaped complementarily to said component.

9. A combination handle/bracket according to claim 8, wherein resilient mounting pads are positioned around a circumference of said second cut out to engage said component.

10. In combination: a portable device;

a component associated with said device; and a combination handle/bracket member comprising a single piece member having a first end and a second end with a 90 degree bend formed between said two ends, said member being secured to said device and having a first central cut-out in said first end forming a pair of opposed legs and a connecting portion at a terminal end of said first end providing a manually graspable area to assist in movement of said device, and a second central cut-out in said second end forming a component receptacle area to receive said component, said member being secured to said device at a location between said manually graspable area and said second cut-out such that said device and said component can be moved together as a unit.

11. A combination according to claim 10, including fastening means for securing said member to said device.

12. A combination according to claim 11, wherein said fastening means comprises means used to secure portions of said device together.

* * * * *